US006691833B1

(12) United States Patent
Elsener et al.

(10) Patent No.: US 6,691,833 B1
(45) Date of Patent: Feb. 17, 2004

(54) ELEVATOR WITHOUT A MACHINE ROOM

(75) Inventors: Hans Elsener, Luzern (CH); Urs Ammon, Ebikon (CH)

(73) Assignee: Inventio AG, Hergiswil (CH)

( * ) Notice: Subject to any disclaimer, the term of this patent is extended or adjusted under 35 U.S.C. 154(b) by 0 days.

(21) Appl. No.: 09/492,484

(22) Filed: Jan. 27, 2000

(30) Foreign Application Priority Data

Feb. 5, 1999 (EP) ..... 99102308

(51) Int. Cl.[7] ..... B66B 11/08; B66B 13/24; B66B 7/00

(52) U.S. Cl. ..... 187/266; 187/254; 187/414

(58) Field of Search ..... 187/401, 239, 187/240, 324, 350, 404, 406, 414, 253, 254, 266; 52/30

(56) References Cited

U.S. PATENT DOCUMENTS

| | | | | |
|---|---|---|---|---|
| 627,257 A | * 6/1899 | Creighton | ..... | 187/313 |
| 837,826 A | * 12/1906 | Handlan, Jr. | ..... | 187/313 |
| 2,028,405 A | * 1/1936 | McLauthlin | ..... | 187/253 |
| 3,412,873 A | * 11/1968 | Barker | ..... | 187/401 |
| 3,768,596 A | * 10/1973 | Solymos | ..... | 187/404 |
| 3,838,752 A | * 10/1974 | Berkovitz | ..... | 187/266 |

(List continued on next page.)

FOREIGN PATENT DOCUMENTS

| | | | |
|---|---|---|---|
| DE | 38 02 386 | 8/1988 | |
| EP | 0 631 967 | 1/1995 | |
| EP | 0 710 618 | 5/1996 | |
| EP | 0 870 722 | 10/1998 | |
| FR | 2508023 | * 12/1982 | ..... 187/401 |
| FR | 2695632 | * 3/1994 | ..... 187/401 |
| JP | 353109356 | * 9/1978 | |
| JP | 401303283 | * 12/1989 | |
| JP | 402147591 | * 6/1990 | ..... 187/413 |
| JP | 403061280 | * 3/1991 | |
| JP | 403177284 | * 8/1991 | ..... 187/270 |
| JP | 403293276 | * 12/1991 | |
| JP | 404209187 | * 7/1992 | |
| JP | 05000789 | 1/1993 | |
| JP | 05097357 | 4/1993 | |
| JP | 405097357 | * 4/1993 | ..... 187/401 |
| JP | 405246662 | * 9/1993 | ..... 187/401 |
| JP | 405306084 | * 11/1993 | |
| JP | 405330752 | * 12/1993 | ..... 187/401 |
| JP | 406009177 | * 1/1994 | |
| JP | 06298473 | 10/1994 | |
| JP | 406321465 | * 11/1994 | |
| JP | 408295477 | * 11/1996 | |
| JP | 09110344 | 4/1997 | |
| JP | 09263372 | 10/1997 | |
| JP | 09278303 | * 10/1997 | |
| JP | 409263372 | * 10/1997 | |
| JP | 409278303 | * 10/1997 | |
| JP | 09309677 | 12/1997 | |
| JP | 411079618 | * 3/1999 | |
| JP | 411106159 | * 4/1999 | |
| JP | 2000072352 | * 3/2000 | |
| JP | 2001171932 | * 6/2001 | |

*Primary Examiner*—Eileen D. Lillis
*Assistant Examiner*—Paul T. Chin
(74) *Attorney, Agent, or Firm*—MacMillan, Sobanski & Todd, LLC

(57) ABSTRACT

An elevator has a car that moves along at least one guiderail in a hoistway and the car is supported by at least one suspension rope that is driven by a drive unit. The drive unit has a drive motor that rotates rope sheave over which the suspension rope passes. The drive unit is located in an upper section of the hoistway and projects over at least part of the car. To assure safe access to the drive unit when the dimensions of the hoistway are efficiently minimized, the car has a closable opening in the roof through which the drive unit is accessible.

11 Claims, 2 Drawing Sheets

U.S. PATENT DOCUMENTS 4,043,430 A * 8/1977 Kraft et al. ..... 187/324
4,126,210 A * 11/1978 Martin ..... 187/401
4,166,517 A * 9/1979 Henderson ..... 187/401
4,415,066 A * 11/1983 Mensik ..... 187/401
4,592,450 A * 6/1986 Schaffer ..... 187/270
4,664,230 A * 5/1987 Olsen ..... 187/406
4,699,251 A * 10/1987 Orndorff et al. ..... 187/401
4,756,389 A * 7/1988 Sakata et al. ..... 187/394
4,830,146 A * 5/1989 Nakamura et al. ..... 187/253
5,226,507 A * 7/1993 Kawarasaki ..... 187/251
5,301,773 A * 4/1994 Jamieson et al. ..... 187/376
5,490,578 A * 2/1996 Aulanko et al. ..... 187/266
5,566,786 A * 10/1996 De Angelis et al. ..... 187/266
5,624,169 A * 4/1997 Bishop et al. ..... 187/404
5,727,657 A 3/1998 Foelix ..... 187/414
5,788,018 A * 8/1998 Mendelsohn et al. ..... 187/404
5,878,847 A * 3/1999 Mustalahti et al. ..... 187/406
5,899,300 A * 5/1999 Miller et al. ..... 187/256
5,944,144 A * 8/1999 Hein ..... 187/270
5,971,109 A * 10/1999 Aulanko et al. ..... 187/263
6,006,865 A * 12/1999 Ammon ..... 187/266

* cited by examiner

ELEVATOR WITHOUT A MACHINE ROOM

BACKGROUND OF THE INVENTION

The present invention relates an elevator having a car that moves along at least one guiderail in a hoistway, and having at least one suspension rope that supports the car, and having a drive unit which has at least one drive motor with a traction sheave driven by it and working in conjunction with the one suspension rope at least, the drive unit being located in an upper section of the hoistway and projecting over at least part of the car.

From the technical article entitled "Aufzüge ohne Triebswerkraum" ("Elevators with no Machine Room") published in "Lift-Report" issue March 1998, an elevator without a machine room is known in which the drive unit is located on supports that are fastened to a hoistway wall in an upper section of the hoistway. Maintenance work is carried out on the drive unit from the roof of the elevator car. So as to be able to observe the drive unit. even when it is in motion, an installation platform is proposed which can be installed from a maintenance platform when required. This elevator requires relatively high hoistway headroom above the car. Furthermore, installing the maintenance platform, or installation platform, in the hoistway is relatively complicated.

SUMMARY OF THE INVENTION

Taking the above-described elevator as the starting situation, the purpose of the present invention is to propose an elevator which, while making good use of the space in the hoistway, meaning having a low hoistway height and small hoistway cross-section, assures safe access to the drive unit, especially if the car is jammed high in the hoistway.

To fulfil this purpose according to the invention, on an elevator of the type mentioned above, it is proposed that the car have a closable opening in its roof through which the drive unit is accessible.

With the elevator according to the invention, maintenance work is carried out from inside the car by use of a maintenance platform located inside the car. The closable opening provided in the roof of the car makes the motor accessible to a service mechanic.

The accessibility of the drive unit above the car is assured even when the car is jammed high in the hoistway. The dimensions of the opening in the roof can vary. In particular, the opening in the roof can comprise the entire car roof, thereby affording good access to the drive unit from all sides.

A significant advantage of the elevator according to the invention is that in addition to good use being made of the cross-section of the hoistway, the height of the hoistway can also be kept very low, because maintenance work can be carried out from inside the car. Since the drive unit of the elevator according to the invention is not passed by the car, drive units of varying construction and dimensions can be used, thereby giving great flexibility. In particular, drive motors with or without gears can be used according to choice. The elevator concept according to the invention can be used with various arrangements of suspension ropes. In particular, by means of return pulleys under the car, the suspension rope can be made to pass beneath the car, or instead of a traction sheave a winding drum can be used. The drive concept according to the invention can also be used on so-called rucksack-type elevators in which the car is guided on one side only. Since the drive unit is located in the upper section of the hoistway, which is also known as the headroom, different methods of fastening the drive unit can be used. For example, the drive unit can be fastened either standing on, or suspended from, transverse beams supported between the hoistway walls.

In an advantageous development, the opening in the roof excludes the area over which the motor projects. Here, the opening in the roof has such dimensions, and is so positioned, as to ensure provision of adequate safe space for the head and upper part of the body of the service mechanic standing in the car, and to avoid crushing parts of the body between the car roof and drive unit in all positions of the car.

It is advantageous for the opening in the roof to be closable by means of a lockable flap.

In an advantageous further development, the flap is connected to an unlocking device that is secured against unauthorized access. This unlocking device can be connected to a switching device in the switchbox that is accessible only to the service mechanic. In an advantageous further development, it is proposed that the flap be constructed so as to be detachable from the car roof and usable as a maintenance platform or part thereof. For example, the flap can be used as the tread surface of the maintenance platform. Further, the flap can have foldout supports so that in the detached state it can be converted into a maintenance platform. The maintenance platform can also be stepped, and have several tread surfaces of different heights.

In another advantageous development the flap is fastened to a supporting device on the roof of the car by means of which the flap can be moved into a maintenance position parallel to the roof of the car. The supporting device can have, for example, holding members constructed in the form of scissors.

An advantageous development has at least one stop to ensure a minimum clearance between the car and the drive unit. This stop can be constructed as a buffer that operates in conjunction with the counterweight.

In an advantageous development of the invention the drive unit is supported on at least one beam which rests on a hoistway wall, or on guiderails of the car, or on guiderails of the counterweight.

In an advantageous further development the one suspension rope at least passes over return pulleys under the car.

The drive unit can be constructed with gears, particularly planetary gears. As already mentioned earlier, a significant advantage of the elevator concept according to the invention is that there are no restrictions on the dimensions of the drive unit.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
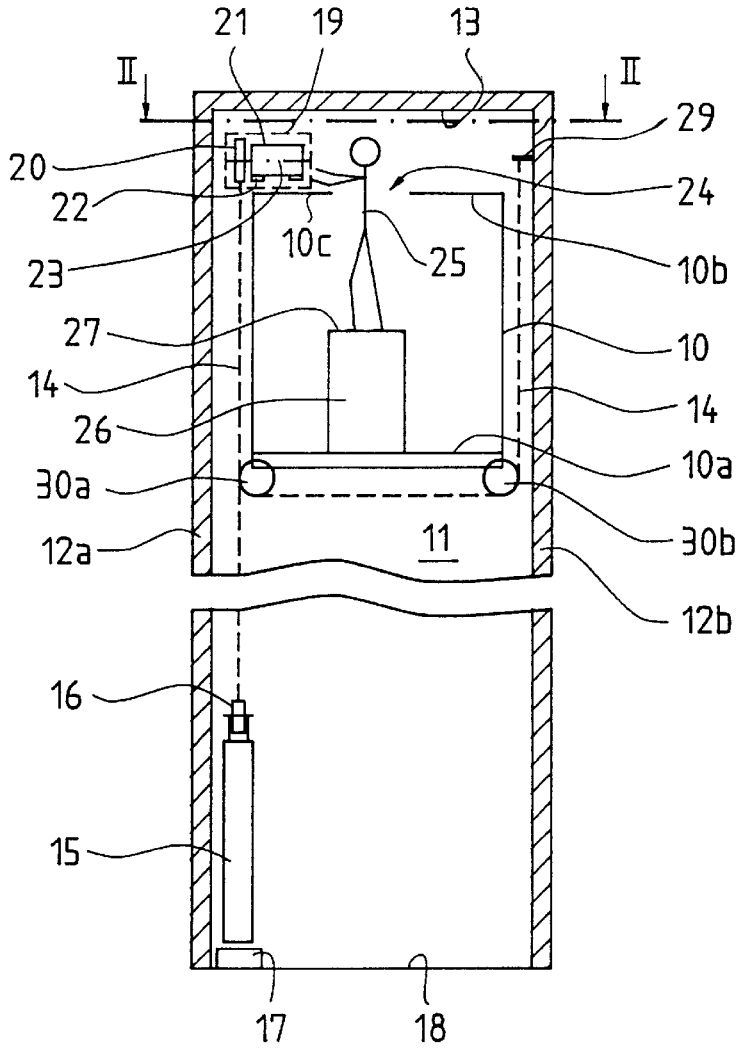
FIG. 1 is a schematic longitudinal cross-sectional view through a hoistway with a first exemplary embodiment of an elevator according to the present invention.

FIG. 1 shows a schematic longitudinal cross-sectional view through an elevator hoistway 11 bounded on opposed sides by a pair of hoistway walls 12*a* and 12*b* that are essentially parallel to each other, at a bottom by a hoistway floor 18 and at a top by a hoistway ceiling 13. In the hoistway 11, there is a car 10 of the elevator for the purpose of transporting passengers. The hoistway 11, which extends over several stories, has on each floor hoistway doors (not shown in the drawing) that can be traveled to by the car 10.

To impart motion to the car 10, the elevator has a drive unit 19 located in the upper section of the hoistway 11 in the so-called headroom. The drive unit 19 has a drive motor 21 with a drive shaft that rotationally drives a rope sheave 20. To provide support to the drive unit 19 there are two beams 22 that are parallel to each other and whose ends are fastened to opposite walls of the hoistway 11.

The car 10 is supported by a set of suspension ropes 14, only one of which is illustrated schematically in the drawing. The suspension rope 14 has a first end that is fastened to an anchor 29 in the upper section of the hoistway 11 close to the hoistway wall 12*b*. Starting from the anchor 29 the suspension rope 14 passes over a pair of diverter pulleys 30*a* and 30*b* mounted on an underside of a floor 10*a* of the car 10 to the rope sheave 20 driven by the drive motor 21. After passing over the rope sheave 20, the suspension rope 14 passes to a counterweight return pulley 16 that is fastened to a counterweight 15. After passing over the counterweight return pulley 16 the suspension rope 14 passes back to an anchor (not shown in the drawing) which is in the upper section of the hoistway 11.

Figure 2:
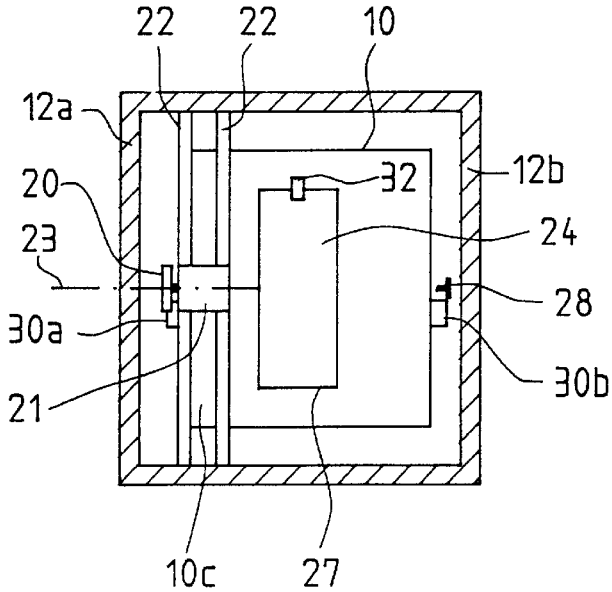
FIG. 2 is cross-sectional view as if taken on the line 2—2 in the FIG. 1 with the car flap closed.

As can be seen in the FIG. 2, the car 10 is guided on two guiderails 28 that run in the longitudinal direction of the hoistway 11. The counterweight 15 is also guided on guiderails 28 that are not shown in more detail. This view shows particularly well that an axis 23 of the drive motor 21 is positioned essentially perpendicular to the hoistway wall 12*a*. The rope sheave 20, on the other hand, rotates in a plane parallel to the hoistway wall 12*a*.

Since the drive unit 19 is located in an upper section of the hoistway 11 which the car 10 does not pass, the dimensions of the car can be chosen in such a manner that essentially the entire cross section of the hoistway can be used. Furthermore, good use is made of the hoistway height without additional safety clearances due to the car 10 having a roof 10*b* in which there is formed an opening 24 that can be closed by means of a flap 27. To prevent improper opening, the flap 27 has an unlocking device 32 that is secured against unauthorized access. This prevents passengers from opening the flap 27 and climbing out of the car 10 during travel. The unlocking device 32 can, for example, be connected to a switchbox of the elevator that is accessible only to a service mechanic 25.

FIG. 1 shows the car 10 in an operational status in which the car is in the maintenance position. The service or maintenance mechanic 25 uses a manual control to move the car 10 until it is close to the drive unit 19. The counterweight 15 cooperates with a stop 17 that take the form of a buffer on the hoistway floor 18. Contact between the counterweight 15 and the stop 17 terminates upward travel of the car 10. This safely prevents contact between the car 10 and the drive unit 19.

As can be seen from both FIG. 1 and FIG. 2, the opening 24 in the roof 10*b* does not extend laterally as far as the drive unit 19. Consequently, the opening 24 excludes an area 10*c* of the car 10 over which the drive unit 19 projects.

To carry out installation or maintenance work, a maintenance platform 26 is placed on the floor 10*a* inside the car 10 beneath the opening 24. The flap 27 can be removed from the opening 24 and placed on the floor 10*a* to serve as a tread surface. The maintenance platform 26 can be constructed to have steps, and have several tread surfaces of different height. The service mechanic 25 can then stand on the maintenance platform 26 and carry out maintenance work on the drive unit 19 through the opening 24. Due to their position, all parts of the drive unit 19 are then easily accessible to the service mechanic 25.

Figure 4:
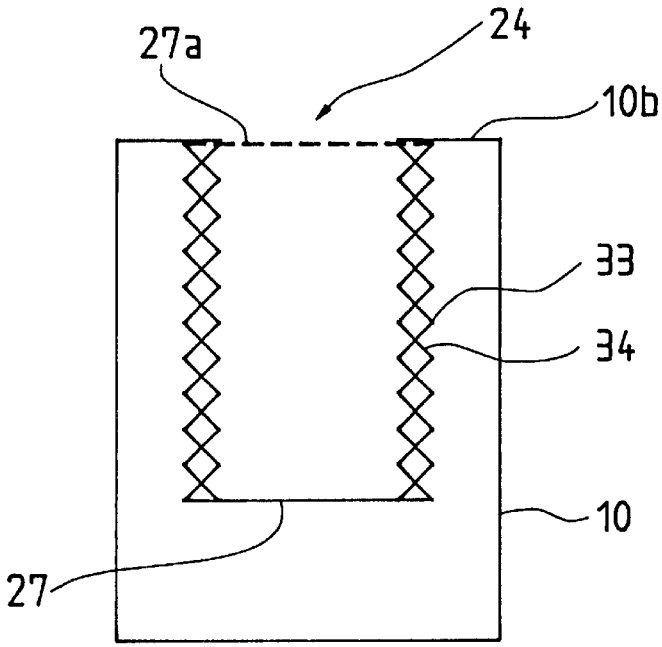
FIG. 4 is a longitudinal cross-sectional view through an elevator car of a further exemplary embodiment according to the present invention.

In the exemplary embodiment shown in the FIG. 4, the flap 27 is hung on a supporting device 33 that is fastened to the roof 10*b* of the car 10. The supporting device 33 has holding members 34 that are constructed in the form of scissors, and onto whose free lower end the flap 27 is fastened. FIG. 4 shows the maintenance position in which the flap 27 has been moved from the opening 24 into the inside of the car 10 by the maintenance mechanic 25. In this position the maintenance mechanic 25 can use the flap 27 as a maintenance platform, and carry out maintenance work on the drive unit 19 through the opening 24 in the roof. In the closed position, shown by a broken line, the flap 27*a* closes the opening 24 in the roof 10*b* of the car.

Figure 3:
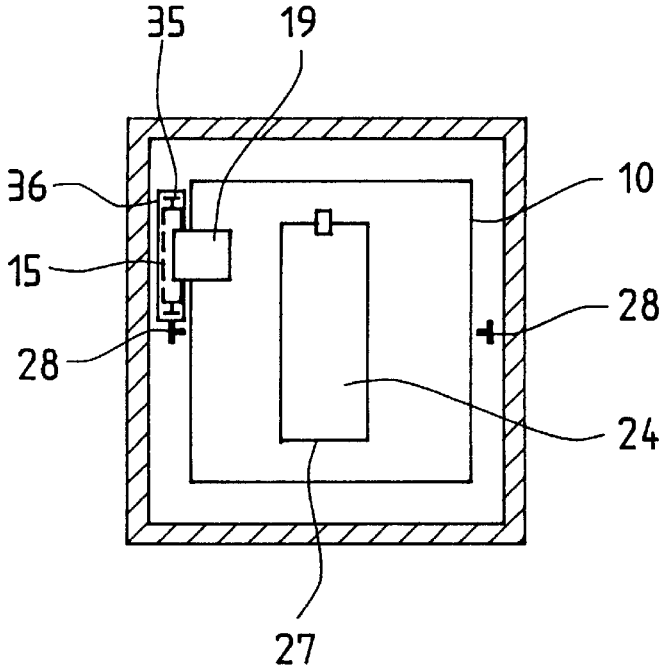
FIG. 3 is a cross-sectional view similar to the FIG. 2 showing another embodiment of the elevator according to the present invention.

FIG. 3 shows a further exemplary embodiment illustrated by means of a cross section similar to FIG. 2. To support the drive unit 19 there is a bracket 36 that is supported at its free end by parallel guiderails 35 of the counterweight 15. The drive unit 19 projects over part of the car 10. The drive unit 19 is easily accessible through the opening 24 in the roof.

Since maintenance work is carried out from inside the car 10, and not from the roof 10*b* of the car, there is no need with any of the exemplary embodiments for a special safety clearance in the upper part of the hoistway 11, which results in optimal utilization of the hoistway height.

Furthermore, with this elevator concept, any drive units 19 with different dimensions can be used. These include traction sheave drives with or without gears, winding drums, hydraulic drives, or linear motors. Moreover, the elevator concept according to the invention can also be used for other arrangements of suspension ropes. Common to all these variants is that the arrangement of the drive unit 19, and execution of maintenance work through a closable opening 24 in the roof 10*b* of the car 10, result in very good utilization of the hoistway 11 in both the horizontal and longitudinal directions.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An elevator car for an elevator installation having at least one guiderail in a hoistway along which the car travels, at least one suspension rope that supports the car, and a drive unit with at least one drive motor driving a rope sheave over which the suspension rope passes, the drive unit being located in an upper section of the hoistway and projecting at least in part over the car, the car comprising:

an elevator car having a roof with an opening formed therein, said opening being in an area of said roof over which a drive unit for said car does not project; and a flap mounted on said car roof in a closed position covering said opening, said flap being operable by a person from inside said car for movement by the person to an open position permitting access from an interior of said car to an exterior of said car and wherein said flap is detachable from said car roof and can be used as a tread surface for a maintenance platform placed on a floor of said car whereby when said car is positioned at a top of a hoistway adjacent the drive unit for said car with said flap in said open position, the drive unit is accessible to the person inside said car through said opening.

2. The car according to claim 1 including an unlocking device connected between said flap and said roof for selectively preventing removal of said flap from said opening.

3. An elevator car for an elevator installation having at least one guiderail in a hoistway along which the car travels, at least one suspension rope that supports the car, and a drive unit with at least one drive motor driving a rope sheave over which the suspension rope passes, the drive unit being located in an upper section of the hoistway and projecting at least in part over the car, the car comprising:

an elevator car having a roof with an opening formed therein, said opening being in an area of said roof over which a drive unit for said car does not project; and a flat mounted on said car roof in a closed position covering said opening, said flap being operable by a person from inside said car for movement by the person to an open position permitting access from an interior of said car to an exterior of said car and wherein said flap is attached to a supporting device fastened to said car roof, said supporting device permitting movement of said flap away from said opening to a maintenance position below said car roof, whereby when said car is positioned at a top of a hoistway adjacent the drive unit for said car with said flap in said open position, the drive unit is accessible to the person inside said car through said opening.

4. The car according to claim 3 wherein said supporting device includes scissors-like holding members connected between said car roof and said flap.

5. An elevator system comprising:

an elevator car traveling along at least one guiderail in a hoistway and having a roof with an opening formed therein;

at least one suspension rope connected between said car and a counterweight;

a drive unit with at least one drive motor driving a rope sheave over which said one suspension rope passes, said drive unit being located in an upper section of the hoistway and projecting at least in part over an area of said car roof not including said opening; and a flap mounted on said car roof and being operable by a person from inside said car for movement by the person from a closed position covering said opening to an open position permitting access from an interior of said car to an exterior of said car, said flap being detachable from said car roof and can be used as a tread surface for a maintenance platform placed on a floor of said car or said flap being attached to a supporting device fastened to said car roof, said supporting device permitting movement of said flap away from said opening to a maintenance position below said car roof, whereby when said car is positioned at a top of the hoistway with said car roof adjacent said drive unit and said flap in said open position, said drive unit is accessible to the person inside said car through said opening.

6. The elevator system according to claim 5 including at least one stop positioned in the hoistway and cooperating with said counterweight to assure a minimum clearance between said car roof and said drive unit.

7. The elevator system according to claim 6 wherein said one stop is a buffer positioned at a bottom of the hoistway.

8. The elevator system according to claim 5 wherein said drive unit is supported on at least one beam that is attached to one of a wall of the hoistway, said one guiderail for said car, and at least one guiderail for said counterweight.

9. The elevator system according to claim 5 including at least a pair of diverter pulleys mounted at a bottom of said car wherein said one suspension rope passes over said diverter pulleys under said car.

10. The elevator system according to claim 5 including an unlocking device connected between said flap and said car roof for selectively preventing removal of said flap from said opening.

11. The elevator system according to claim 5 wherein said supporting device includes scissors-like holding members connected between said car roof and said flap.

* * * * *